US006935648B2

(12) United States Patent
Beck

(10) Patent No.: US 6,935,648 B2
(45) Date of Patent: Aug. 30, 2005

(54) MOBILE SELF-RECOVERY LIFT CHAIR

(76) Inventor: Terry L. Beck, 15280 Pine Dr., Renton, WA (US) 98058

( * ) Notice: Subject to any disclaimer, the term of this patent is extended or adjusted under 35 U.S.C. 154(b) by 0 days.

(21) Appl. No.: 10/277,315

(22) Filed: Oct. 22, 2002

(65) Prior Publication Data

US 2004/0075237 A1 Apr. 22, 2004

(51) Int. Cl.[7] ..... A61G 5/10
(52) U.S. Cl. ..... 280/250.1; 297/DIG. 4
(58) Field of Search ..... 280/250.1, 304.1; 297/DIG. 4

(56) References Cited

U.S. PATENT DOCUMENTS

| | | | | | |
|---|---|---|---|---|---|
| 4,229,039 | A | * | 10/1980 | Day | 297/232 |
| 4,834,411 | A | * | 5/1989 | Willey et al. | 280/250.1 |
| 5,058,221 | A | * | 10/1991 | Abraham | 5/81.1 HS |
| 5,601,302 | A | * | 2/1997 | Beard et al. | 280/250.1 |
| 5,800,016 | A | * | 9/1998 | Allred | 297/344.17 |
| 5,816,655 | A | * | 10/1998 | Hoegh | 297/338 |
| 6,467,785 | B2 | * | 10/2002 | Toppses | 280/250.1 |
| 6,505,365 | B1 | * | 1/2003 | Hanson et al. | 5/613 |
| 2002/0149168 | A1 | * | 10/2002 | Brown | 280/250.1 |

FOREIGN PATENT DOCUMENTS

| | | | | |
|---|---|---|---|---|
| GB | 2124557 A | * | 2/1984 | A61G/5/00 |
| JP | 06121813 A | * | 5/1994 | A61G/5/02 |

* cited by examiner

*Primary Examiner*—Kevin Hurley
(74) *Attorney, Agent, or Firm*—David L. Tingey

(57) ABSTRACT

A self-recovery lift chair provides an improved way for an individual who has fallen to return to a seated position and then be able to stand or wheel to another location. The wheeled chair includes a lift frame and a seat suspended from a lift mechanism in the frame. The seat moves vertically from contact with the floor to variable or above normal seat heights. Seat sides fold from vertical to horizontal to serve as a loading sideboard. The lift mechanism comprises a lift trolley connected to the seat, a reversible motorized drive mechanism powered by a rechargeable battery, and a detachable actuation switch that can be operated by the user or an assistant. The lift trolley is stabilized in the frame by a vertical stabilizing rod connected on each side of a drive receiver on a central vertical threaded drive rod. Brakes keep the chair stationary until it is necessary to be moved. A pivoting handle allows the lift chair to be moved like a wheel chair or when turned outward as a support point for the assistant during manually assisted transfers.

19 Claims, 8 Drawing Sheets

MOBILE SELF-RECOVERY LIFT CHAIR

BACKGROUND

1. Field of Invention

This invention relates to a wheeled lift chair advantageous for an incapacitated individual who has fallen to the floor and is too weak or stiff to get up, to be able to slide himself or herself onto the seat of the lift.

The invention herein also relates to assistive devices, more precisely an injury prevention device that protects healthcare providers from injuring their back, neck and shoulders while attempting to lift someone off of the floor.

2. Prior Art

The Center for Disease Control reported that one in three adults over the age of 65 will fall annually. One half of this group will suffer repeat falls. With each decade of life this percentage increases. They have reported that 50% of the people who fall and are unable to get up for just a few hours, will die within 6 months, and that 40% of all extended care admissions are because of repeat falls. In addition for every 1000 extended care residents there will be 1600 falls a year.

Alarming statistics of an aging population that will double between the year 2000 and 2016. The problem of getting people up and the costs associated with the injuries this endeavor causes is a substantial drain to the healthcare system.

The statistic while alarming do not tell the entire story of the fear, loss of autonomy and the disruption of lives that chronic falls cause. With debilitating diseases such as diabetes on the rise there will be an ever-increasing number of falls do to the peripheral neuropathies and weakness. These neuropathies while not life threatening do lead to loss of feeling in the legs and combined with decreases in visual acuity lead to many falls which an individual can not get up from. When this happens and there is a spouse available to help them back up the spouse invariably gets injured, further decreasing the couples overall quality of life.

Several inventors have created lifts that have to do with assisted transfers from one object to another, or in and out of cars, pools, bathtubs and beds but only one addresses the need to recover someone from the floor. The prior art discloses one patent to Hough, U.S. Pat. No. 5,816,655 that addresses a vertical lift chair that an individual could scoot into from the floor and be raised to a seated height. This chair lacks the ability to be moved from one location to another with the person in the chair or out. As falls usually exhaust an individual from the exertion of trying to get up, it is typical for these individuals to need to return to bed to rest before they can walk again. This prior art demands that the individual be capable of walking away from the lift, which they may not be able to do.

The prior art of Hough also has serious safety issues with major shear points between the seat arms and the surrounding lifting frame where an arm or hand could be caught as the lift is raised.

The sliding protective plates used to hide the mechanical workings will eventually snag an article of clothing and cause serious injury. The basic design of this feature may lead to binding over time due to the inherent complexity of the design. Also the fabrics used to cover the motor and drive mechanism will create an environment where someone trying to stand is going to trap their foot between the frame and cloth and suffer another fall. The fabric also lies in close proximity to the rotating drive mechanisms and could become wrapped in the mechanism thus rendering the chair inoperative.

A non-structural problem also exits in the prior art of Hough. In today's world of medical third party payers, a requirement exist for such a lift to be equipped with wheels in order to be reimbursed by an insurer. Without meeting this requirement most of the older or handicapped individuals will be denied access to this useful device due to financial reasons.

The prior art of Allred, U.S. Pat. No. 5,800,016 demonstrates a vertical lifting chair with wheels. The art demonstrates that it does not provide the capability to pick someone up from the floor, nor was it intended to do so. The prior art of Allred does not discuss a braking method to keep the chair stationary during transfers, which is a major safety concern.

Other prior art demonstrates a variety of vertical lifts for the handicapped. They address the need to assist a person out of a chair, or up and down in the bath, or pool, or in and out of bed. There are a number of lifts designed to lift people and wheelchairs in and out of vehicles or up and down stairs using a variety of propulsion mechanisms be it drive screws and reduction gears, levers, pneumatics and hydraulic cylinders and combinations of all of the aforementioned. They do not address the need for an individual who is alone to get up after a fall.

Therefore, objects of the wheeled lift chair of the present invention are:

(a) to provide a mobile self-recovery lift chair that a person can use independently to get up from the floor and regain their ambulatory status;

(b) to provide a mobile self-recovery lift chair that when raised will stay stationary if the person trying to stand thrusts to one side;

(c) to provide a mobile self-recovery lift chair that can be moved room to room, or up and down stairs or outside;

(d) to provide a mobile self-recovery lift chair that sits flush with the ground, allowing someone to scoot onto the seat easily, and when raised to be higher than normal seat height so as to decrease the amount of strength it takes to stand.

(e) to provide an assistive device to care centers, hospitals and homes where it is necessary to quickly get someone off of the floor safely;

(f) to provide a mobile self-recovery lift chair that is small, light, mobile and have as few pinch or entrapment places as possible and provide physical safety to the operators;

(g) to provide a mobile self-recovery lift chair that provides counterbrace holds to stabilize the chair while assisting in transfers into and out of the chair.

Further objects and advantages of my invention will become apparent from a consideration of the drawings and ensuing description.

SUMMARY

These objects are achieved in a novel wheeled lift chair with a vertically adjusted seat to facilitate loading of a person from the floor and with hinged seat sides to facilitate loading of a person from a raised platform, such as a bed. The chair provides a mobile self-recovery lift chair that lowers to a position in contact with the floor and thus enables an individual who has fallen to the floor to get to a seated position in the chair. Because the person can enter the chair from the person's fallen position, caregivers need not lift the person into the chair, thereby decreasing the incidence of injury to caregivers incurred while attempting to lift someone from the floor.

The chair provides an improved way for an individual who has fallen to return to a seated position and then to stand or wheel to another location. The chair includes an enclosed lift frame with rear wheels for mobility, a seat that moves vertically from contact with the floor to a selective seat height. Forward wheels provide support of the chair under the seat near the chair center of gravity when loaded. A seat lift mechanism comprises a lift trolley connected to the seat and contained within the lift frame. Releasable wheel brakes actuated from a seat arm keep the chair stationary during loading and unloading. A rechargeable battery provides power for the motorized lift mechanism.

Handles on the lift frame behind the lift frame, suitable for use by an assistant when moving the chair in traditional manner, can be rotated outward as a counterbrace that the assistant uses to stabilize the chair during loading and unloading. One assistant hand is positioned on the handle while the other may be used to lift a fallen individual into the seat, thereby relieving the strain on the assistant's back, neck, and shoulders therein reducing the likelihood of injury to the assistant.

Arms on seat sides hinge from a normal vertical position to a horizontal position as a transfer board that allows the intended occupant to move from a raised position such as a bed or gurney to or from the chair by sliding over the seat side rather than standing out of the chair.

DETAILED DESCRIPTION OF THE PREFERRED EMBODIMENTS

Figure 1:
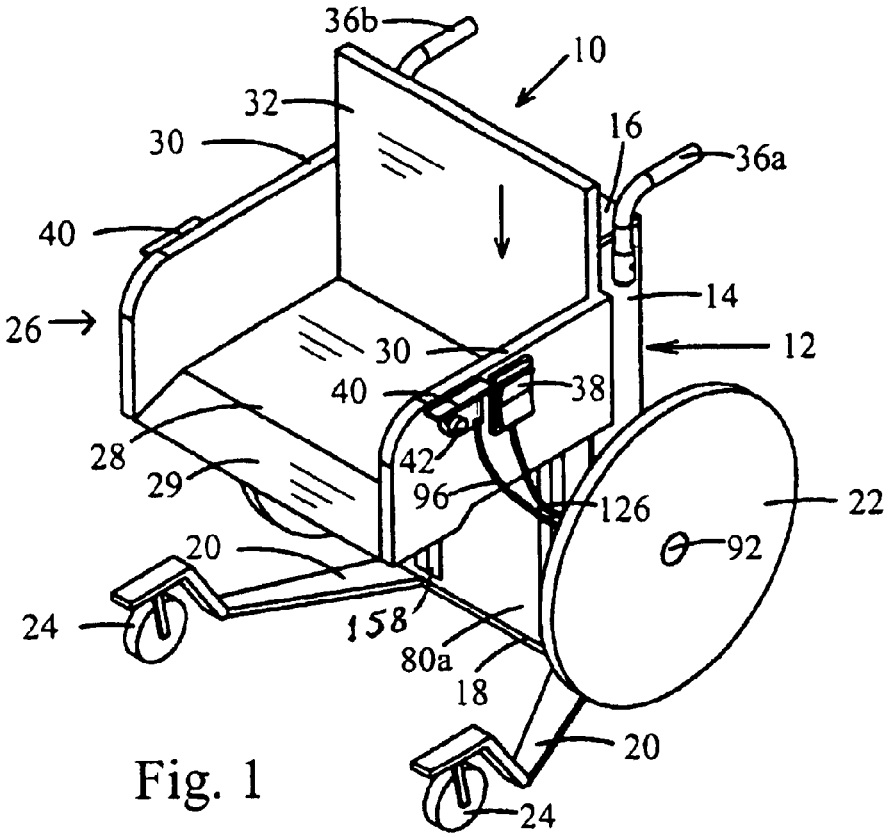
FIG. 1 is a perspective view of the mobile self-recovery lift chair of the present invention with its seat in a raised position, which raised position may be higher than a comfortable seated position to allow easier exit
Figure 2:
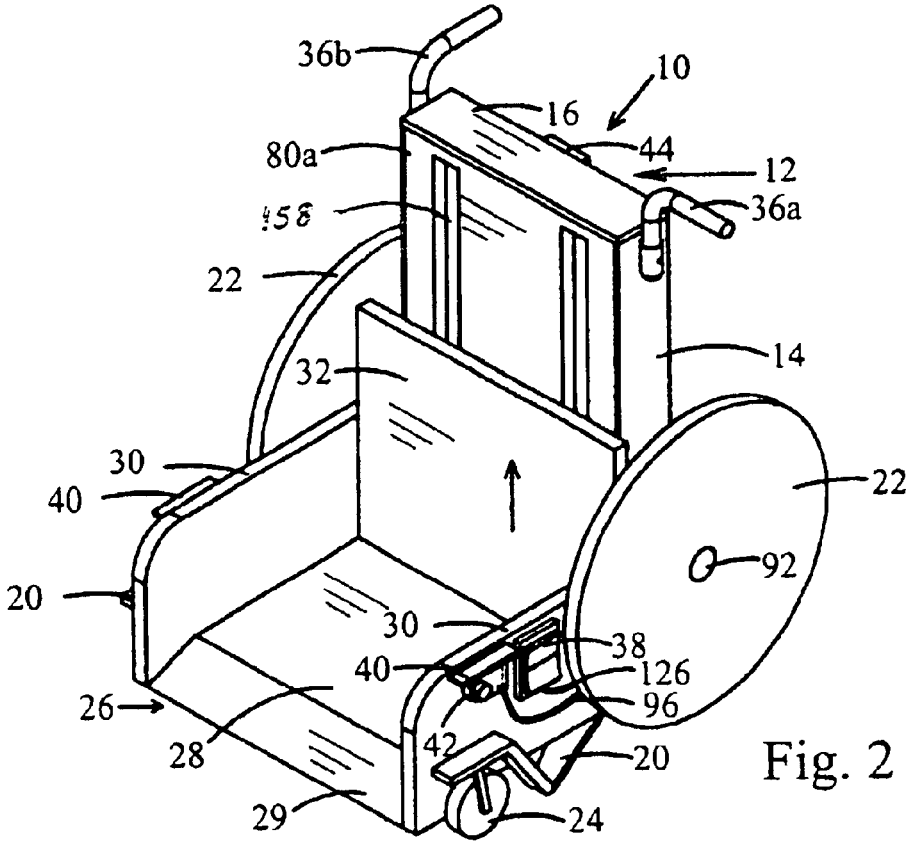
FIG. 2 is a perspective view of the mobile self-recovery lift chair of FIG. 1 with the seat in a lowered position, shown with the seat in contact with the floor to allow ease of entry, with the left handle rotated as a counterbrace.

As shown primarily in FIG. 1 and FIG. 2, the lift chair 10 of the present invention comprises a lift frame 12 with rearward wheels 22 mounted rotatably on lift frame sides, a seat 26, a lift trolley 15, and forward wheels 24 also on chair sides supporting forward extending frame legs 20.

Figure 6:
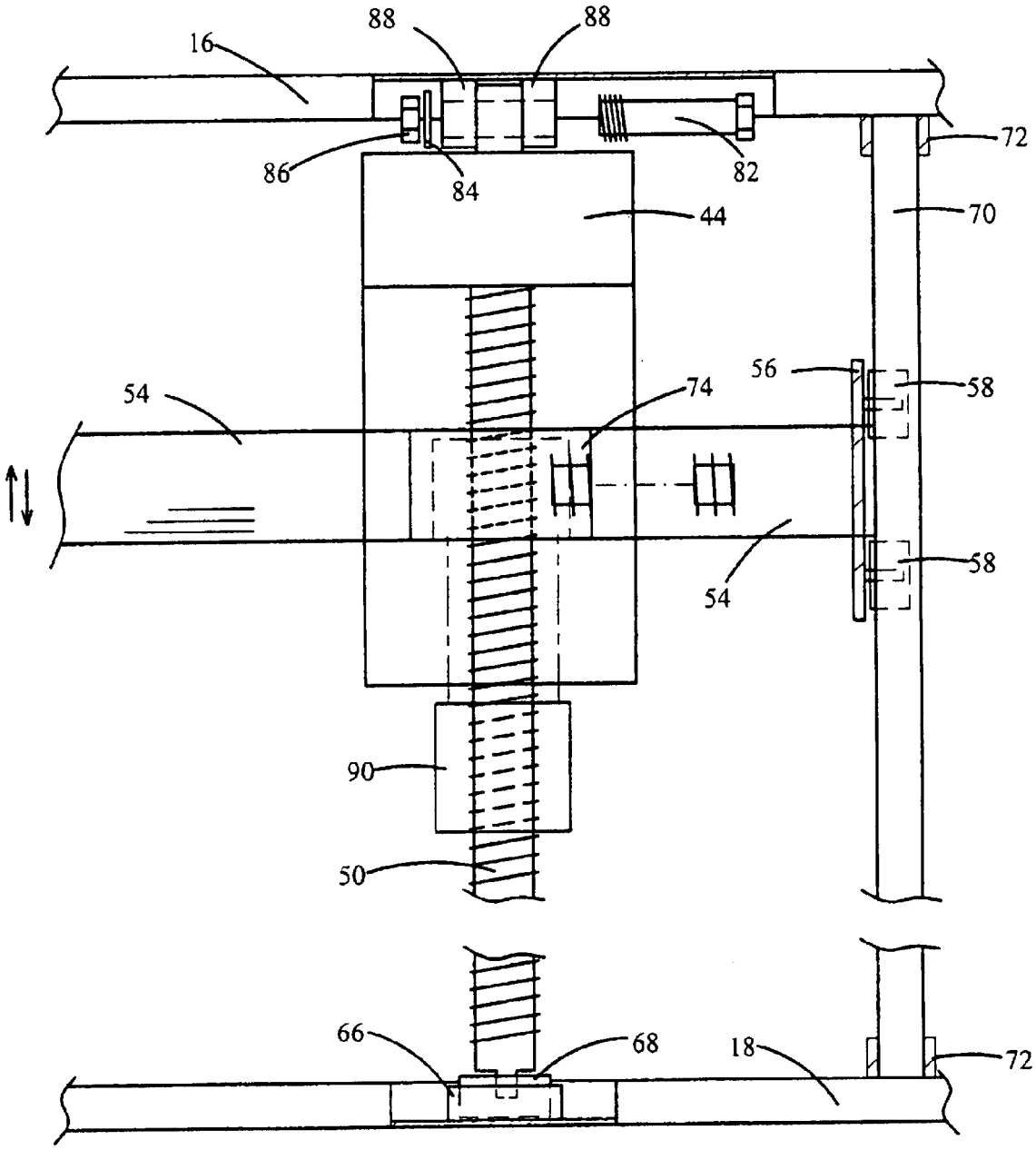
FIG. 6 is a sectioned front elevation of a lift frame and lift trolley of the mobile self-recovery chair, showing a vertical rotational threaded drive rodmounted centrally in the lift frame by a clevis mounted gear motor on the inferior surface of the top cross member and connected with a bolt, washer and nut.

Lift frame 12 comprises upright opposing closed lift frame sides 14 spaced apart by closed bottom and top horizontal cross members 16 and 18, the frame sides and cross members having lateral extent therein forming a box-like enclosure with front and back openings, the openings covered by opposing front cover and back covers 80*a* and 80*b* on the frame sides and cross members, as shown in FIG. 6. Rear covering 80*b* closes the back of the lift frame 12, shielding motor 44 and lift trolley 15 from fingers and clothing and other objects.

Legs 20 extend forwardly from lift frame 12, extending horizontally under the seat 26 from the bottom cross member 18 to which it is typically attached and outward to the seat side. As the legs 20 emerge from under the seat generally perpendicular to the lift frame 12, they angle upward to receive pivotally mounted front wheels 24 such that the seat when in its lowest position locates between the left and right forward wheels with said forward wheels on the legs alongside the seat, thus allowing the seat to lower to the floor.

The seat 26, forward of the lift frame 12, comprises a seat platform 28, seat arms 30, and a back 32, and an angled front seat portion 29 between the seat platform 28 and the floor when the seat 26 is lowered to its lowest position to facilitate ease of entry.

Figure 3:
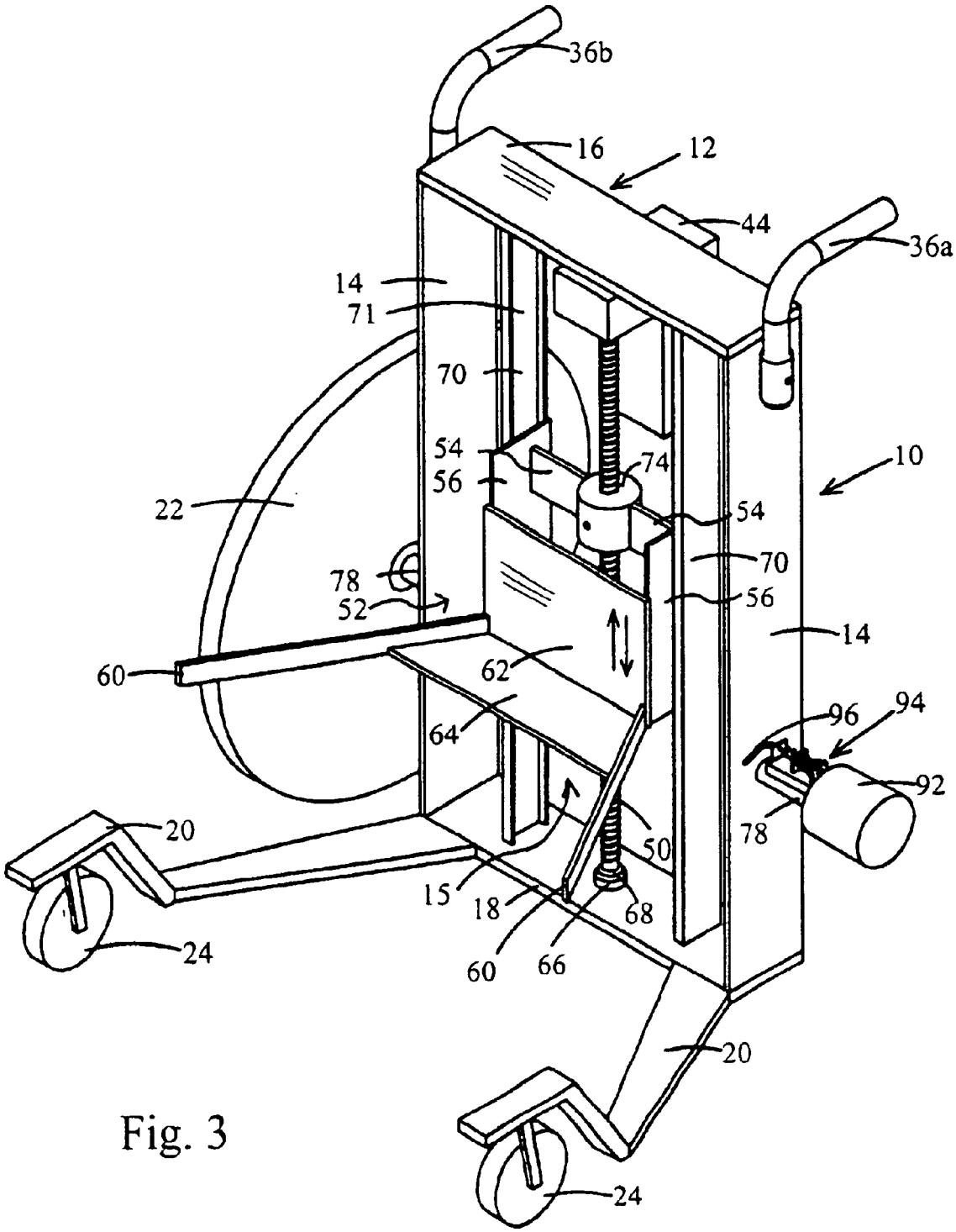
FIG. 3 is a perspective view of the lift trolley and locations of a wheel braking mechanism.
Figure 4:
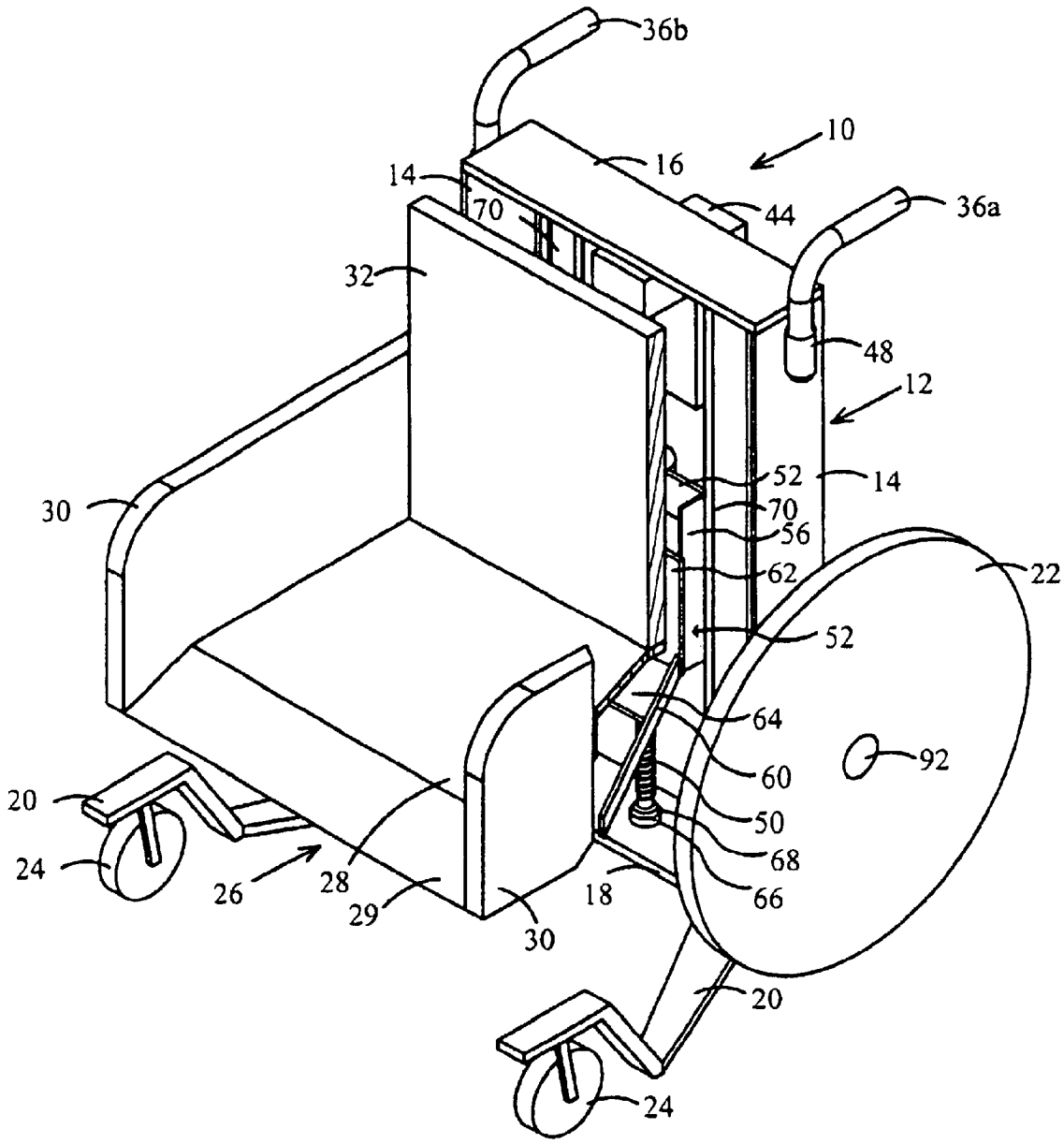
FIG. 4 is a perspective sectioned view of the mobile self-recovery lift chair showing the seat supported on the lift trolley by interconnecting lift arms.
Figure 5:
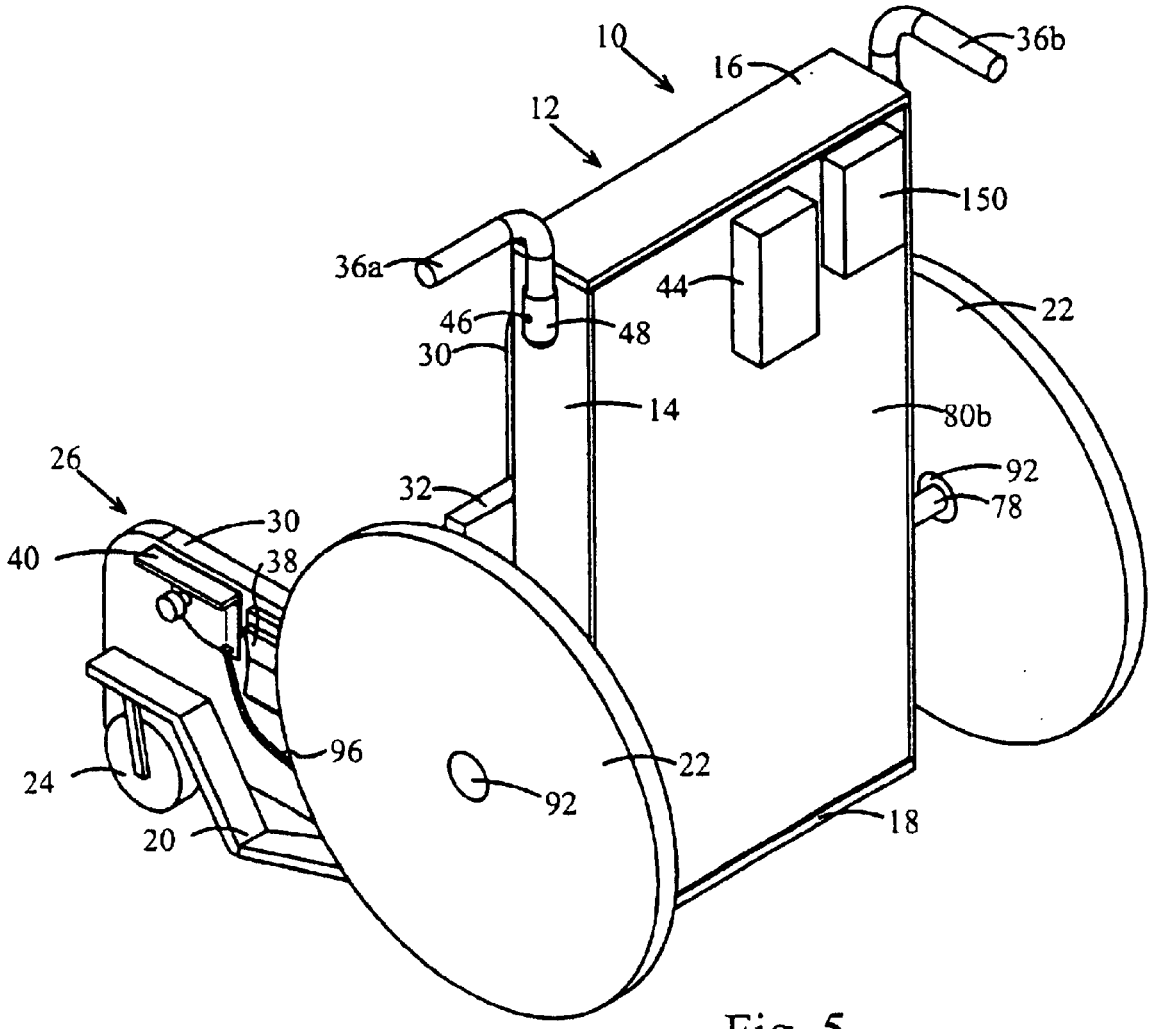
FIG. 5 is a rear perspective view illustrating the frame rear covering, a motor driving the lift trolley.

Referring primarily to FIG. 3, FIG. 4 and FIG. 6, the seat moves vertically by action of the lift trolley 15. A rechargeable onboard battery 150 mounts to the back covering 80*b* as illustrated, but may be mounted anywhere on the lift frame that is convenient. An actuator 38 connects the onboard battery 150 to the monitor 44 with electric wire 126. The actuator is removably attached to the seat 26 typically with hook and loop tape (not shown) so it can be conveniently removed for actuation apart from the chair.

The lift trolley 15 comprises a drive receiver 74 threaded over threaded drive rod 50 with horizontal struts 54 extending from opposite drive receiver sides between the drive receiver 74 and vertically dependent plates 56, respectively, each opposing respective frame sides 14. Securely fastened to each of the vertically dependent plates 56 are a pair of vertically-aligned rollers 58 as shown in FIG. 6. With the seat connected to the drive receiver 74, the rollers are vertically aligned and engaged within longitudinal grooves 71 of vertical stabilizer tracks 70 as guides to direct vertical motion of the seat maintaining the seat 26 parallel to the ground in resisting lateral and rotational stresses should a seat load not be centered.

Figure 9:
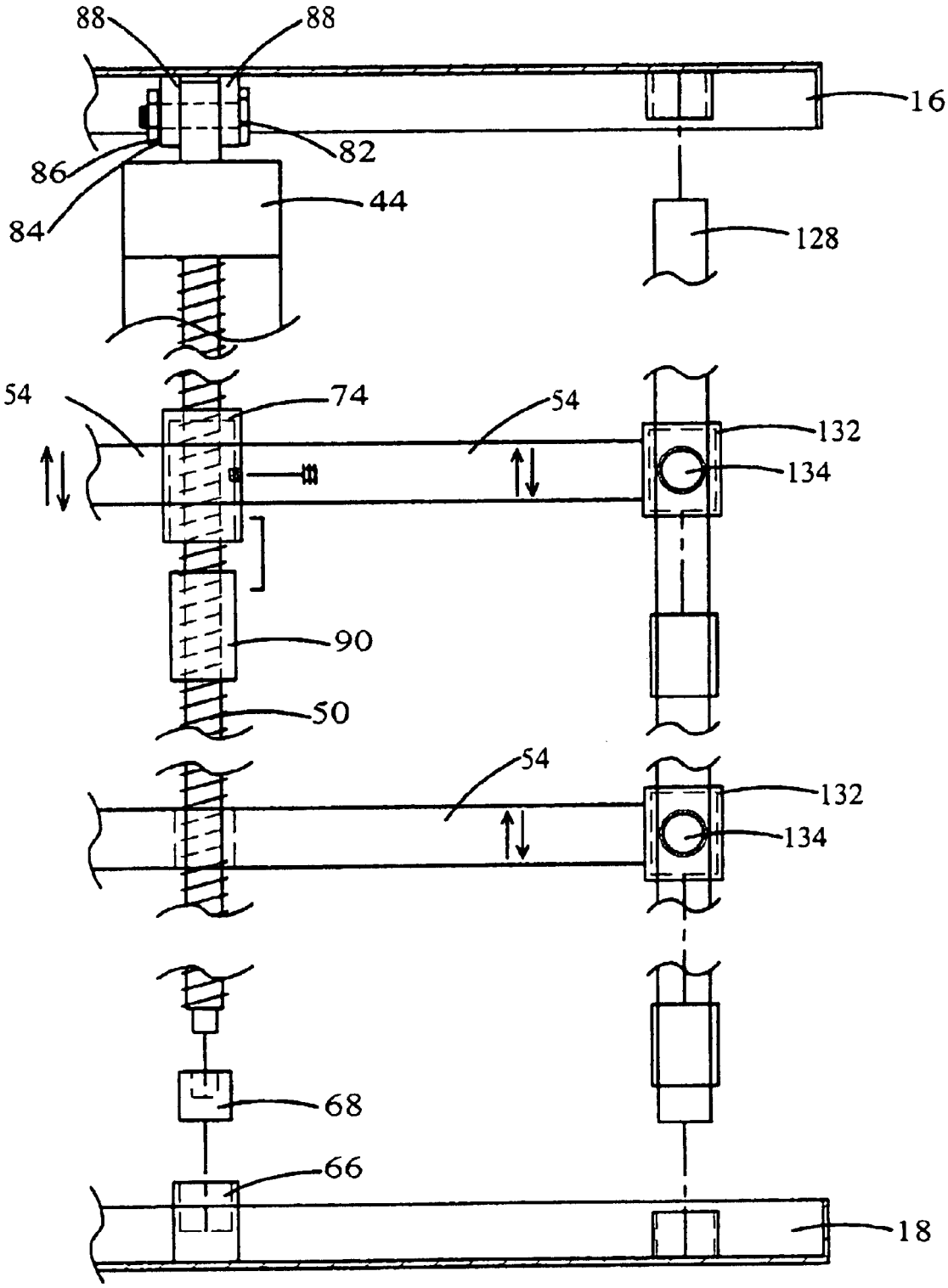
FIG. 9 is a partial sectioned front view of an alternative embodiment of a lifting frame and lift trolley.
Figure 11:
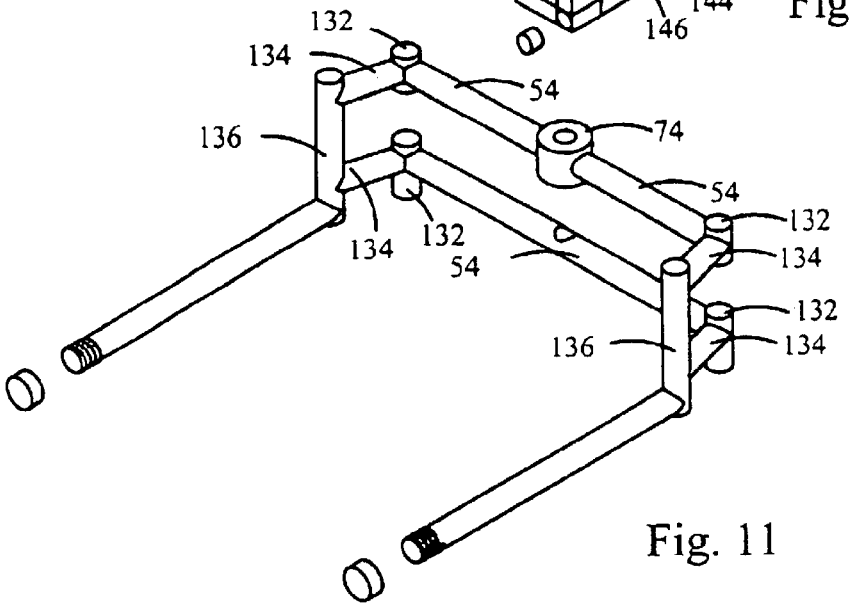
FIG. 11 is a perspective view of an alternative strut assembly stably interconnecting the seat with the lift trolley.

The stabilizer tracks 70 are attached to the top and bottom cross members 16 and 18 in stabilizer track receivers 72. The rollers 58 in grooves 71 are meant to be construed generically to include all mechanisms that guide and stabilize the drive receiver 74 in vertical motion. For example, in an alternative embodiment shown in FIG. 9, and FIG. 11, instead of the rollers 58 in groove 71, the track 70 comprises a vertical rod 128. The vertical rod 128 fits slidably in bushing 132 on the end of struts 54 or on the vertically dependent plate 56 on the end of the struts 54. Also, as an alternative embodiment, each vertically dependent plate 56 can be substituted by a vertical strut 136 and one or more forward struts 134 extending between the bushing 132 and the vertical strut 136. For added stability, a second horizontal strut 55 can be added parallel to strut 54 connected to said bushing 132 on each end or to an additional bushing 133 that is similarly connected to the vertical strut 136 by an additional forward strut 134', the vertical rod 128 also passing slidably through the additional bushing 133. The vertically dependent plates 56, or equivalently vertical struts 136 on forward struts 134, project forward through the front covering 80, as illustrated in FIG. 1 and FIG. 2, through front covering slots 158.

As shown in FIG. 4, a pair of substantially horizontal lift arms 60 extend forward from the vertically dependent plates 56 and support the seat 26. Vertical upper truss 62 attaches between the right and left vertically dependent plates 56 and horizontal lower truss 64 extends forward from the vertical truss 62 horizontally between the horizontal lift arms 60 as a brace and further seat support.

As shown in FIG. 6, vertical rotational threaded drive rod 50 mounts centrally in the lift frame 12 by a mounted gear motor 44 engaging clevis 88 central on the interior surface of the top cross member 16, secured therein by a bolt 78, washer 84 and nut 86, or other suitable fastening means. A suitable high density material such as Delron or a thrust bearing 68, mounted in a bearing receiver 66 on the bottom cross member 18 receives the threaded drive rod 50 on the bottom cross member 18. This arrangement anchors the lower end of the drive shaft centrally in the bottom cross-member 18, allowing rotation in clock-wise or anti-clockwise direction. Threaded drive nut 90 is encased in a drive nut receiver 74, retained by a setscrew, and moves vertically on the threaded drive rod 50 with drive nut rotation.

This arrangement allows for the seat 26, lift trolley 15, drive nut 90, threaded drive rod 50, motor 44, and the top cross member 16 to be pre-assembled as a first unit. The lift frame 12 with the front wheels 24 and rear wheels 22 attached form a second unit. The seat 26 can then be lowered into the lift frame 12 by sliding the rollers 56 into the groove 71 of the stabilizer tracks 70. The threaded drive rod 50 engages the bearing 68 in the bottom cross member 18 allowing the top cross member 16 to be fastened to the lift frame 12 capturing the upper end of the stabilizer tracks 70 in stabilizer receiver 72 on the interior surface of the top cross member 16 completing the structure of the mobile self-recovery lift chair.

Figure 7:
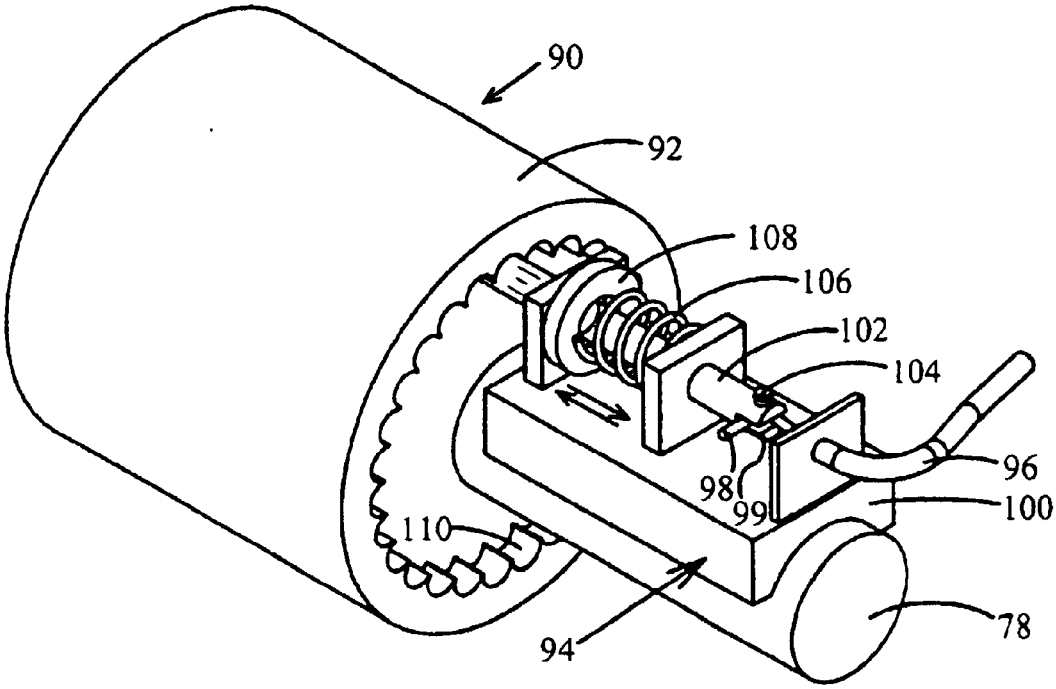
FIG. 7 is a partial sectional perspective view of a hub brake with the wheel removed.
Figure 8:
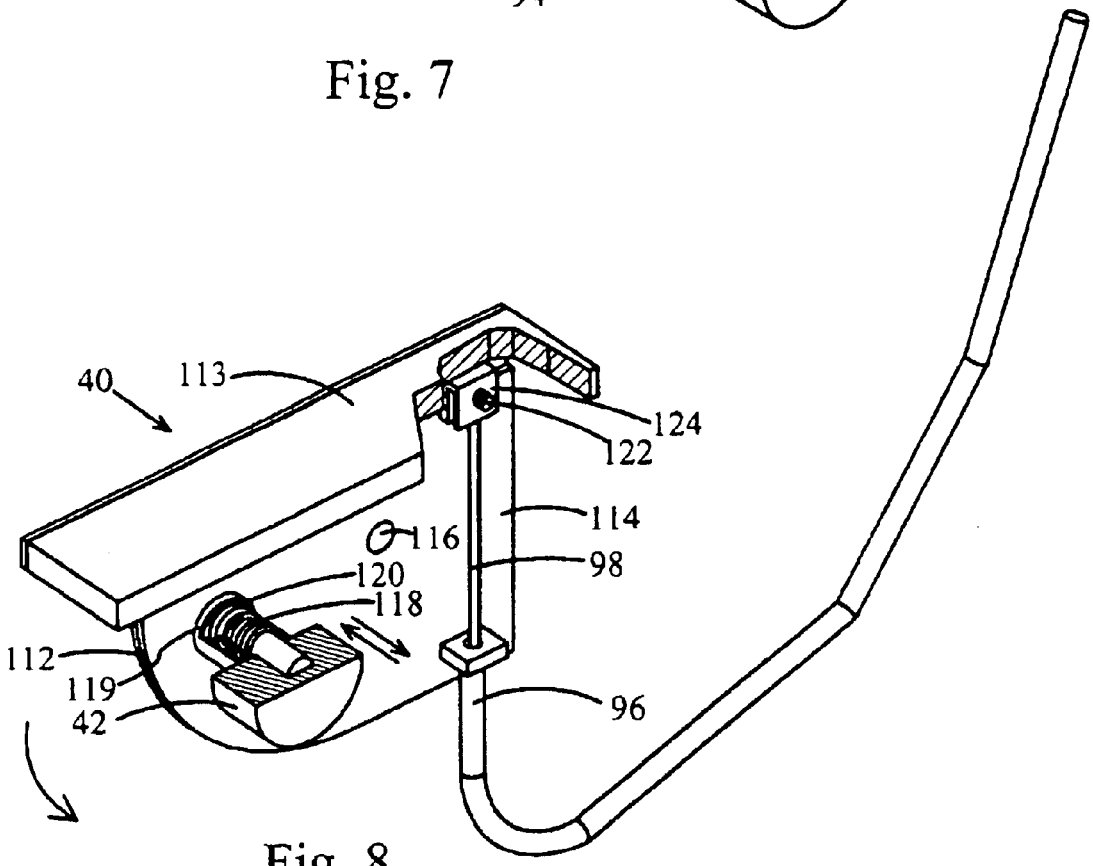
FIG. 8 is a sectioned perspective view of a brake handle, showing the attachment of the brake cable, release knob, fixed and moveable plates.

Referring to FIG. 7, and FIG. 8, a braking mechanism 94 comprises brake handles 40 on each seat arm 30, brake 90 adjustably attached to rear wheel hub 92 on each of frame vertical sides 14 of the lift frame 12. The brakes 90 and brake handles 40 are each joined by tensioning wire 98 located slidably within the brake cable 96. The adjustability of the brakes 90 on the wheel hub 92 allow the brakes 90 to move in and out in relationship to the wheel hub 92 by brake base plate 100 for adjustment of the brakes. A brake release pin 102 is held in one of a plurality of brake pin retention slots 110 by spring 106 and retaining clip 108, which is connected to the pin 102. The release pin 102, normally centered in the brake retention slots 1 10 in the hub 92 of the rear wheel 22, is withdrawn from the brake retention slots 110 as tensioning wire 98 is pulled through cable 92 by the actuation of the brake handle 40. This releases the brakes allowing the lift chair to be easily moved. The release pin is secured in a slot 99 in brake release pin 102 by a setscrew 104.

Each handle 40 comprises a fixed mounting plate 112 and a handle rest 113 attached to a moveable plate 114 that is pivotally attached around pivot point 116. A wire clasp 124 and a setscrew 122 attach the tensioning wire 98 to the moveable plate 114. A spring 118 and retaining clip 120 give inward force to a pull pin 42 causing the pull pin to drop into a hole 119 in the fixed plate 112 when the brake handle rest 113 and moveable plate 114 is pivoted about the pivot pin 116. Thus, when the brake handle rest 113 is depressed, the brake 90 is released and the chair can be moved. The handle rest 113 is held depressed until the pull pin 42 is manually pulled out of hole 119.

Figure 10:
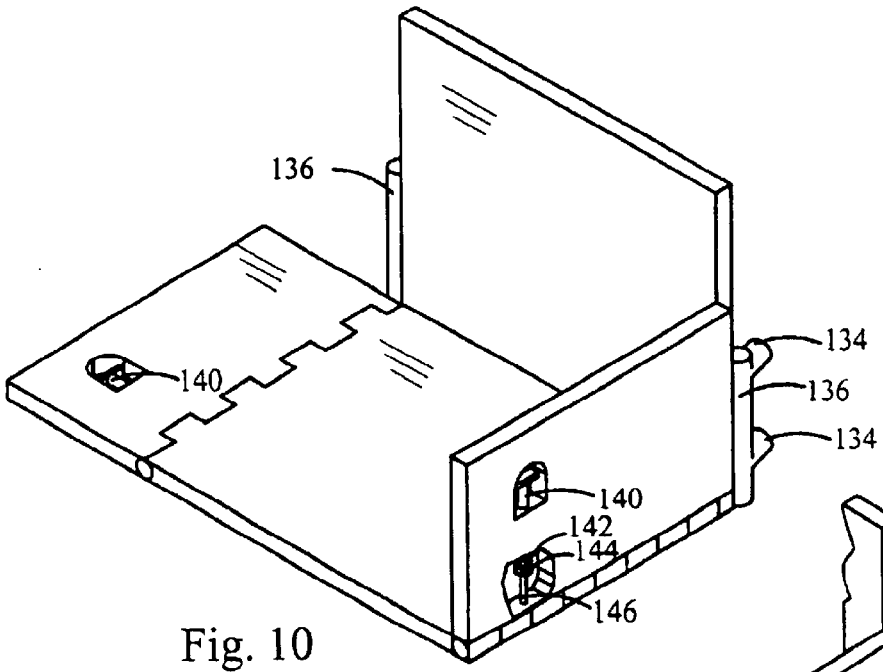
FIG. 10. is a perspective view of an alternative seat for a mobile self-recovery lift chair employing a fold down seat arm.
Figure 12:
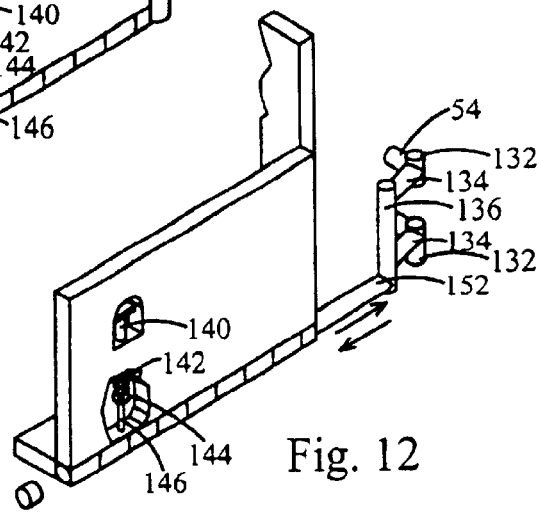
FIG. 12 is a partial, part section of an alternative seat partially showing the lift trolley strut assembly with the lift arm used as a hinge pin for the fold down seat arm, and also showing a releasable arm lock.

As shown in FIG. 10 and FIG. 12, the seat arm 30 can be rotated from a vertical position to a horizontal position as a sliding board to transfer someone who is too weak to stand to slide into the chair from its side, supported by the arm 30 released into a horizontal position. Typically, the seat 26 and the arm 30 are hinged together around lift arm 60 as a hinge pin. Thus the seat arm 30 rotates around lift arm 60 between vertical and horizontal positions. A lock secures the seat arm 30 in its vertical position; when the lock is released, the seat arm is free to rotate to its horizontal position, or any intermediate position. The lock comprises an arm release handle 140 connected to arm release rod 146, a handle release return spring 142 over the release rod 146, a spring retaining clip 144 on the release rod 146 against the return spring 142 that biases the arm release rod into a hole (not shown) in the lift arm 60 to secure the seat arm 30 in its vertical position. The seat arm 30 is released by lifting the arm release handle 140 that pulls the release rod 146 out of the hole in lift arm 140 allowing it to rotate.

A handle 36 pivotably attached to the top of each side of said frame 12 that can be turned from a first position **36*a* rearward of the frame outwardly from said lift frame 12 to a second position 36*b* sideward of the frame 12**

I claim:

1. A self-recovery device for lifting a fallen human from the ground comprising A frame comprising upright opposing lift frame sides spaced apart by bottom and top horizontal cross members and having rotatable wheels disposed to support the frame, a lift trolley comprising a plurality of vertical control tracks attached to said bottom and top horizontal cross members, a threaded drive rod that is also attached between said bottom and top horizontal cross members, a drive receiver threaded over the threaded drive rod, a plurality of horizontal struts attached on horizontal strut first ends to the drive receiver, vertical support plates attached on horizontal strut second ends rollers mounted on said vertical support plates disposed to ride in said tracks therein constraining vertical movement of the drive receiver on the threaded drive rod, a seat attached to said lift trolley, motion of which is controlled by said rollers in said tracks.

2. A mobile self-recovery device as declared in claim 1, further comprising a motor rotatably driving said threaded drive rod causing said drive receiver to move vertically on the threaded drive rod as the threaded drive rod rotates.

3. A wheeled lift chair comprising a wheeled frame, a vertically moving lift trolley on said frame, a seat supported by said lift trolley, a seat arm, a lift arm adapted as a hinge pin with the seat and the seat arm hinged together around the lift arm such that the seat arm is rotatable on the lift arm between a vertical position and a horizontal position therein adaptable as a sliding board in transferring someone laterally onto the seat.

4. A wheeled lift chair comprising, a lift frame, rearward wheels rotatably mounted on lift frame sides, frame legs extending forward from the lift frame, forward wheels rotatably mounted on frame legs, a lift trolley mounted to the lift frame movable vertically on the frame, a seat mounted to and suspended from the lift trolley forward of the lift frame and the lift trolley, the seat being height-adjustable on the lift trolley relative to the lift frame and an underlying floor between a first position with the seat in contact with the floor and a raised seating position.

5. A wheeled lift chair comprising, a lift frame, rearward wheels rotatably mounted on lift frame sides, frame legs extending forward from the lift frame forward wheels rotatably mounted on frame legs, a lift trolley mounted to the lift frame movable vertically on the frame comprising a plurality of vertical stabilizer rods attached between said bottom and top horizontal cross members, a threaded drive rod that is also attached between said bottom and top horizontal cross members, a drive receiver threaded over the threaded drive rod, a plurality of horizontal struts attached on horizontal strut first ends to the drive receiver, a vertical support member attached on a second end of each horizontal strut, guides mounted on said vertical support members disposed to slidably engage said stabilizer rods therein constraining vertical movement of the drive receiver on the threaded drive rod, a seat mounted to and suspended from the lift trolley forward of the lift frame and the lift trolley.

6. The wheeled lift chair of claim 5 wherein the vertical stabilizer rods comprise tracks with longitudinal grooves and the guides comprise rollers rolling in said grooves.

7. The wheeled lift chair of claim 5 wherein left and right top horizontal struts attach between drive receiver left and right sides and guides on left and right vertical support members, respectively, and said vertical support member comprises a vertical strut forward of the stabilizing rod and at least one forward strut extending between a guide on the stabilizing rod and the vertical strut.

8. The wheeled lift chair of claim 7 further comprising upper and lower vertically aligned guides slidably on each of left and right vertical stabilizer rods, said left and right top horizontal struts attached to said lower guides, upper and lower forward struts between upper and lower guides on each of left and right vertical stabilizer rods, respectively.

9. The wheeled lift chair of claim 8 further comprising a bottom horizontal strut between lower guides further stabilizing said seat in vertical adjustment.

10. The wheeled lift chair of claim 8 further comprising a pair of lift arms supporting said seat, extending forward substantially horizontally from the said vertical struts respectively, and wherein the frame encloses the lift trolley with closed frame sides spaced apart by closed bottom and top horizontal cross members, a closed back on the frame sides and cross members, and a front covering on the frame sides and cross members having front covering slots through which said forward struts extend from the lift trolley inside the frame to said vertical struts outside the frame to which the lift arms are attached, the frame thus substantially closing the lift trolley.

11. The wheeled lift chair of claim 5 wherein left and right top horizontal struts attach between drive receiver left and right sides and guides on left and right vertical support members, respectively, and said vertical support members comprise right and left vertically dependent plates each respectively opposing frame sides and extending forward from the lift trolley.

12. The wheeled lift chair of claim 10 wherein the frame encloses the lift trolley with closed frame sides spaced apart by closed bottom and top horizontal cross members, a closed back on the frame sides and cross members, and a front covering on the frame sides and cross members having front covering slots through which said vertically dependent plates extend from the lift trolley inside the frame to the seat outside the frame, the frame thus substantially closing the lift trolley.

13. The wheeled lift chair of claim 10 further comprising a vertical upper truss attached between the right and left vertically dependent plates.

14. The wheeled lift chair of claim 11 further comprising a pair of lift arms supporting said seat, extending forward substantially horizontally from the vertical support member, and a horizontal lower truss extending forward from the vertical truss between the horizontal lift arms as a brace and further seat support.

15. The wheeled lift chair of claim 5 further comprising a pair of lift arms supporting said seat, extending forward substantially horizontally from the vertical support member.

16. The wheeled lift chair of claim 5 further comprising said lift arms horizontally aligned.

17. The wheeled lift chair of claim 5 including a braking mechanism comprising, a seat arm on each seat side, brake handles on each seat arm, said rear wheel including a hub on each frame side and brake retention slots in the hub, a brake adjustably attached to rear wheel hubs, the brakes and brake handles each joined by a tensioning wire located slidably within a brake cable, a brake release pin held in one of a plurality of brake pin retention slots by a spring and a retaining clip that are connected to the pin such that when the release pin, which is normally centered in the brake retention slots in the hub of the rear wheel, is withdrawn from the brake retention slots as tensioning wire is pulled through cable by the actuation of the brake handle, thus releasing the brakes and allowing the lift chair to be moved.

18. A wheeled lift chair comprising a frame, rearward wheels rotatably mounted on lift frame sides, frame legs extending forward from the lift frame forward wheels rotatably mounted on frame legs, a lift trolley mounted to the lift frame movable vertically on the frame, a seat mounted to and suspended from the lift trolley forward of the lift frame and the lift trolley, wherein the frame encloses the lift trolley with closed frame sides spaced apart by closed bottom and top horizontal cross members, a closed back on the frame sides and cross members, and a front covering on the frame sides and cross members having front covering slots through which connection members extend from the lift trolley inside the frame to the seat outside the frame, the frame thus substantially closing the lift trolley.

19. A wheeled lift chair comprising a frame, rearward wheels rotatably mounted on lift frame sides, frame legs extending forward from the lift frame forward wheels rotatably mounted on frame legs, a lift trolley mounted to the lift frame movable vertically on the frame comprising a plurality of vertical stabilizer rods attached between bottom and top horizontal cross members, a threaded drive rod that is also attached between said bottom and top horizontal cross members, a drive receiver threaded over the threaded drive rod, a plurality of horizontal struts attached to the drive receiver on horizontal strut first ends, guides on horizontal strut second ends disposed to slidably engage said stabilizer rods therein constraining vertical movement of the drive receiver on the threaded drive rod.

* * * * *